United States Patent [19]

Jarach

[11] 4,385,559

[45] May 31, 1983

[54] DAMPENING DEVICE FOR OFFSET PRINTING MACHINES FOR ALTERNATE AND SELECTIVE UTILIZATION OF WATER OR OF A WATER-ALCOHOL MIXTURE

[76] Inventor: Roberto Jarach, Via Monte Rosa, 17, Milano, Italy

[21] Appl. No.: 224,298

[22] Filed: Jan. 12, 1981

Related U.S. Application Data

[63] Continuation of Ser. No. 14,453, Feb. 23, 1979, abandoned, which is a continuation-in-part of Ser. No. 841,637, Oct. 12, 1977, abandoned.

[30] Foreign Application Priority Data

Dec. 28, 1978 [IT] Italy ..... 31378 A/78

[51] Int. Cl.[3] ..... B41F 7/26; B41F 7/40

[52] U.S. Cl. ..... 101/148; 101/348; 101/352; 101/DIG. 14

[58] Field of Search ..... 101/148, 147, 349, 350, 101/351, 352, 206–209

[56] References Cited

U.S. PATENT DOCUMENTS

| | | | |
|---|---|---|---|
| 2,065,535 | 12/1936 | Morse | 101/148 |
| 2,581,687 | 1/1952 | McWhorter | 101/348 |
| 2,607,291 | 8/1952 | Jacobson | 101/148 |
| 2,682,218 | 6/1954 | Baumgartner | 101/247 |
| 3,096,710 | 7/1963 | Wojciechowski | 101/148 |
| 3,209,685 | 10/1965 | Henkel | 101/349 |
| 3,326,122 | 6/1967 | Wildeman | 101/148 |
| 3,411,442 | 11/1968 | Muhlich | 101/148 |
| 3,491,686 | 1/1970 | Zurick | 101/352 |
| 3,603,254 | 9/1971 | Siebke | 101/148 |
| 3,673,959 | 7/1972 | Jezuit et al. | 101/148 |
| 3,688,694 | 9/1972 | Preuss et al. | 101/148 |
| 3,744,414 | 7/1973 | Krochert et al. | 101/148 |
| 3,749,011 | 7/1973 | Abendroth et al. | 101/148 |
| 3,757,689 | 9/1973 | Koch et al. | 101/148 |
| 3,911,816 | 10/1975 | Hutton et al. | 101/148 |

FOREIGN PATENT DOCUMENTS

| | | | |
|---|---|---|---|
| 861825 | 1/1971 | Canada | 101/148 |

*Primary Examiner*—J. Reed Fisher
*Attorney, Agent, or Firm*—Bucknam and Archer

[57] ABSTRACT

A method and apparatus are described for operating a printing press in which the dampening fluid is water or an alcohol water mixture and alternately and selectively switching from water to said alcohol-water mixture. The device supplies dampening fluid to the plate cylinder and is separate from the inking assembly. The device comprises a dampening assembly formed by two dampening rollers tangentially rotatably contacting the plate cylinder, a vibrating assembly formed by at least one axially vibrating first roller (3) in rolling engagement with the dampening roller; a transfer roller (2) in rolling engagement with the axially vibrating first roller (3) and with a dipping roller (1) which is partially immersed in a tray V containing the dampening fluid; a metering and paring assembly formed by the dipping roller and a metering-paring roller (5) contacting only the dipping roller upstream of the contacting zone between the dipping roller (1) and the transfer roller (2); a recovering and paring assembly formed by the dampening roller and a second vibrating roller (6) which contacts only the dampening roller downstream of the contacting zone between the dampening roller and the plate cylinder. The axially vibrating first roller (3) imparts an axial reciprocating motion to the second vibrating roller (6), by means of a lever responsive to the vibration of the first vibrating roller.

6 Claims, 7 Drawing Figures

37
41
40
28
36
30
38
23
6
29
33
25
39
26
28
24
27
4'
31
3
35
L

DAMPENING DEVICE FOR OFFSET PRINTING MACHINES FOR ALTERNATE AND SELECTIVE UTILIZATION OF WATER OR OF A WATER-ALCOHOL MIXTURE

This is a continuation of application Ser. No. 014,453 filed Feb. 23, 1979, now abandoned, which is a Continuation-in-Part of my co-pending United States patent application Ser. No. 841,637 filed Oct. 12, 1977, now abandoned.

BACKGROUND OF THE INVENTION

The present invention relates to an improved dampening device, utilizing a water and water-alcohol mixture, for use on offset printing machines.

Offset printing machines are well known in the art, and accordingly a detailed description thereof is deemed not to be necessary.

However, to facilitate complete understanding of the present invention, it is pointed out that in the offset lithographic system, the "form" or "plate" is completely flat, i.e. is not in relief, and inking thereof is carried out by exploiting a well known physical-chemical process.

This process, which forms the basis of offset photographic inking, causes a repulsion between an oily substance, which in the present case is the printing ink and water, or more generally the dampening liquid.

The surface of the plates, made of zinc, aluminum or of multiple different metals, on which has previously been formed the subject to be printed, has to be moistened before the inking operation in order to assure the necessary repulsion of the ink from the non-engraved or etched portions.

Accordingly, each printing unit of the offset printing machines is provided with a dampening or moistening device which acts to moisten or dampen the plate as wound onto the plate cylinder.

These dampening devices comprise a plurality of counter-rotating rollers, in part driven and in part frictionally-moved by the adjacent rollers, including at least a dipping roller, which is partially immersed in the dampening liquid, and at least a so-called "dampening" roller.

This latter tangentially contacts the plate cylinder and another intermediate roller which may itself receive, from a further roller and by tangential contact, the dampening liquid from the dipping roller.

The dampening roller, or rollers is or are generally coated with rubber and, if necessary in order to assure an optimal supplying of the liquid, with a braiding or textile covering.

Advantageously, one of the intermediate rollers performs a reciprocating axial movement in order to aid a homogenous distribution of the dampening liquid, which is taken up and carried by surface adhesion.

For this reason, and on the analogy of the rollers provided with this type of movement and which are present in the inking assemblies, it is called a "vibrating" roller.

It is also known that in offset printing it is essential to maintain an equilibrium between the water and ink, and that the ideal equilibrium is obtained if it is possible to reduce to a minimum the amount of water supplied to the plate, and to adjust the ink under these conditions of minimum dampening.

The metering of the dampening liquid, transferred to the plate, is obtained in various ways: for example, one of the intermediate rollers, in particular that referred to as the transfer roller, which is located adjacent to the dipping roller, is supported in such a way as to be shiftable parallely to itself, and is cyclically moved or driven in such a way as to periodically moved away from and then again rest on said dipping roller.

Due to this movement, the amount of liquid transferred onto the plate is a function of the ratio of the effective time of operation of the printing unit, and the sum of the intermittent contact times of the transfer and dipping rollers.

It should furthermore be pointed out that additional members are used in order to aid the metering of the dampening liquid, and an even distribution of the liquid film onto the transversal dimension of the system, i.e. in the direction of the roller axes.

These members may carry out a selective distribution of the liquid, with more at the centre or at the sides of the rollers, depending on printing requirements.

In particular, there is used an auxiliary roller, the so called distributing or metering roller, which tangentially contacts, with an adjustable pressure, the first dipping roller of the series of rollers which commences with the dipping roller, and hence with the dampening roller or rollers, and supported to be pivotable in a tangential plane perpendicular to the plane of the axes of said rollers.

Furthermore, in some machines, there is adopted a technical solution according to which the dampening roller or one of the dampening rollers also carries out the function of the end inking roller of the system or of one of the inking systems or assemblies, thereby supplying onto the plate a liquid film formed by a mixture or emulsion of ink and wetting liquid.

The more conventionally and usually used dampening liquid is water, which however presents the drawback of the instability of the water-ink optimal-equilibrium, the obtaining and maintaining of which are indispensable conditions for a quality production.

This equilibrium is more and more difficult to be obtained as, in order to provide a proper tonality of colour, the water amount has to be reduced.

In relatively recent years, has been introduced the use of suitably metered water-alcohol mixtures, which provided the advantages well known to those skilled in the art.

However, the use of alcohol requires the adoption of particular expedients of preparation or setting, and especially skilled operators.

Furthermore, this use may be difficult, or even impossible, under some environmental conditions such as, for example, in tropical climates.

In relatively crecent years it has been attempted to solve this problem by providing machines which, when suitably adapted, may be constructed or set to operate both with the conventional water dampening and with alcohol dampening, i.e. with a water-alcohol mixture.

However, these latter types of machines have until now been affected by considerable drawbacks.

OBJECTS OF THE INVENTION

In view of the above reasons, it is an object of the pesent invention to provide an improvement in offset printing machines such that they are capable of alternatively and selectively operating at will either with the conventional type of water dampening or with a water-alcohol mixture dampening, of high yield and qualitative level, without carrying out any operations other than substitution of the transfer and dampening rollers, and which machines are not affected by the drawbacks of the known machines.

In particular, the present invention relates essentially to a dampening assembly which is completely separated with respect to the inking assembly.

BRIEF DESCRIPTION OF THE DRAWINGS

These and other functional and constructional features of the improved dampening assembly, for use on offset printing machines, according to the present invention, will be apparent from the several figures of the accompanying drawings, in which.

Figure 1:
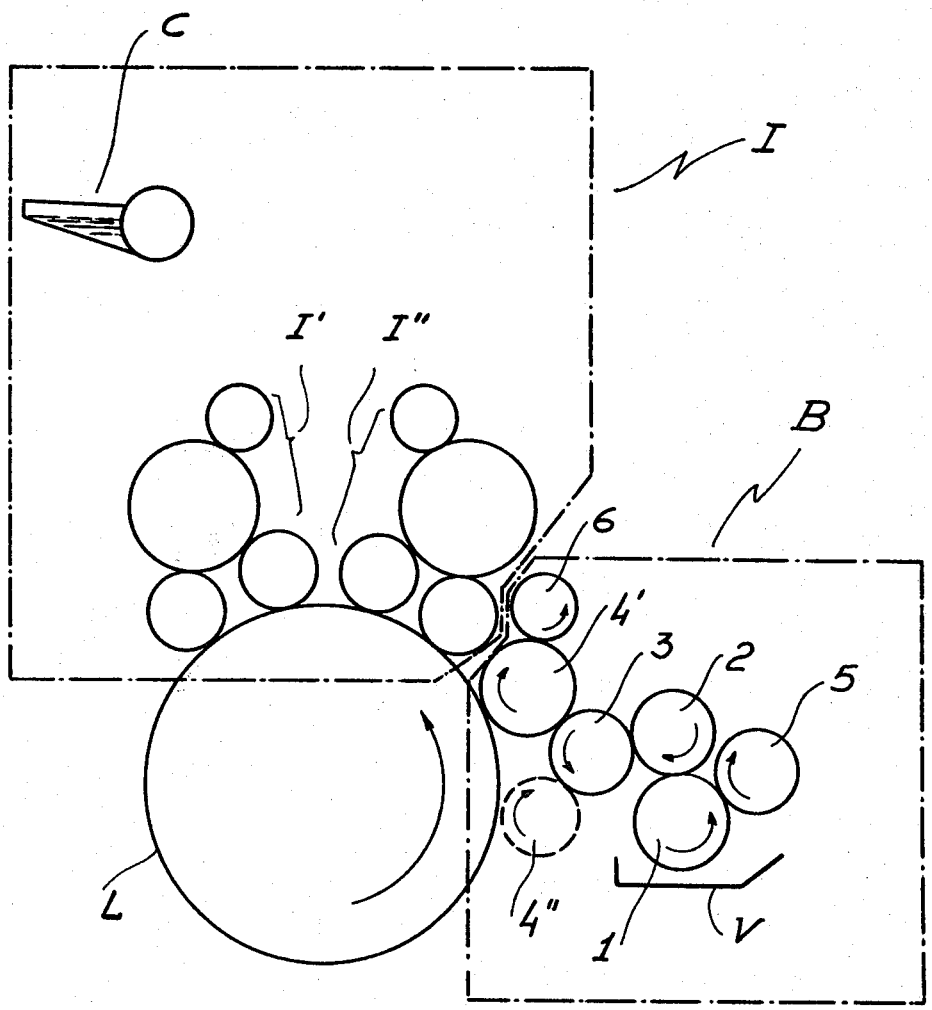
FIG. 1 is a schematic view of the dampening assembly according to the invention.

As illustrated, the dampening assembly according to the present invention comprises, in order corresponding to the direction according to which the dampening liquid contained in a tray V is transferred and distributed onto the surface of a plate L, a dipping roller 1, a transfer roller 2, a vibrating roller 3 and at least one dampening roller 4', possibly but not critically associated with a second dampening roller 4''.

This dampening device further comprises a metering-paring roller 5 tangentially contacting only the dipping roller 1 located upstream, with respect to the direction of rotation, (and hence to the direction of transportation) of the liquid, of the contacting point between said dipping roller and said transfer roller.

The improved dampening system further comprises a second vibrating roller 6 tangentially contacting only the dampening roller 4' at a point downstream, with respect to the direction of rotation, and hence to the direction of transportation, of the liquid, of the contacting point between said dampening roller and the plate cylinder L.

Of the aforesaid rollers, the dipping roller 1 has a plated metal surface, and is driven by a motor and reducer assembly provided with a speed variator, in order to obtain metering of the dampening liquid.

The transfer roller 2, which is covered with rubber, and, in the use with water dampening, with a textile braiding, is driven by the vibrating roller 3 and mounted in such a way as to be adjustable in order to obtain, by modifying the pressure, a transferring of the proper amount of dampening liquid.

This pressure is exercised by a spring 10, through the tension rod 9, the movable hinge 22 and the roller holding arm 7, pivoted onto the fixed pin 8.

In particular, the aforesaid spring is mounted onto said tension rod 9 and acts between the nut and adjusting backing nut 11 and the fixed axis 12.

The proper distribution of the pressure of the spring 10 between the dipping roller 1 and the vibrating roller 3 is obtained by rotating the eccentric bush 14, mounted on the roller holding arm 7, without which rotates the pin 15 of the transfer roller 2, and locking said eccentric bush 14 onto said roller holding arm, in the desired position, by means of the screw 13.

The application and release of the pressure of the transfer roller 2 onto the dipping roller 1 and vibrating roller 3, are servo-driven and are carried out by the pneumatic cylinder 16, the piston rod 17 of which rotates, through the movable hinge 18, the arm 19 hinged onto the fixed axis 12 and the bush-cam 20 rigid therewith.

The rotation of the bush-cam 20 acting under the washer and the adjusting nut 21 located at the free end of the tension rod 9, and the recovering of the spring 10, causes said tension rod 9 to raise and lower respectively.

Said tension rod, in turn, through the movable hinge 22, causes the roller holding arm 7 to rotate, said roller holding arm 7 being pivoted on the fixed pin 8, thereby causing the pressure to be released or applied.

The aforesaid first vibrating roller 3, having a plated metal surface and being driven by the cylinder-plate 1, is provided with an axial reciprocating movement.

That same vibrating roller (FIGS. 3 and 4) is effective to impart to the second vibrating roller 6, through the swinging lever 23, as pivoted onto the fixed pin 24, a reciprocating axial movement, offset by 180°.

The aforesaid fixed pin 24 is mounted and locked, by the nut 25, onto the supporting member 26 which is hinged or articulated on the fixed pivot or pin 27 which is in turn mounted on the supporting member 28 of said second vibrating roller and pressure mechanism thereof.

By this approach, and by loosening the set screw 29, it is possible to rotate the aforesaid supporting member 26 and to withdraw the bearings 30 and 31 from the groove of the collars 32 and 34 respectively fixed onto the pin 33 of the second vibrating roller 6 and onto the pin 35 of the vibrating roller 3, thereby allowing for said rollers to be removed from the supporting members thereof.

The pressure of the aforesaid second vibrating roller onto the dampening roller 4' is adjustable and is directly exercised by the spring 36 which is housed, with some projection therefrom, in the interior of the screw 37 and is guided by the pin 38 fixed onto the movable supporting member 39 carrying the bearing of said second vibrating roller.

This spring works between the bottom of the housing or seat thereof in the interior of the screw 37, and the aforesaid movable supporting member.

The adjustment of the pressure is obtained by loading the spring to a greater or lesser extent, through the tightening and loosening of the screw 37 in the seat thereof as formed in the cap 40 of the supporting member 28 upon loosening the back-nut 41.

The dampening rollers 4' and 4'', which are covered with rubber and, in the water wetting use, by a textile braiding, are driven by friction by the vibrating roller 3 and are supported in such a way as to allow for the contact pressure thereof, both onto the cylinder-plate L and onto the vibrating roller 3 to be adjusted.

In particular, the application and release of the pressure of the aforesaid dampening rollers, onto the cylinder-plate L, are servo-driven and are carried out by the pneumatic cylinder 42, the piston rod 43 of which rotates, through the movable hinge 44 the arm 45 articulated onto the fixed pin 46.

In turn, the aforesaid arm 45, through the movable hinge 47, the piston rod 48 and the movable hinge 49, rotates the arm 50, the axis 51 with which said arm is rigid, and the cam 52 rigid with said axis or axle 51.

The rotation of said cam 52, which acts directly onto two dampening roller holding arms 53 and 54, which are articulated onto the axis or axle 35 of the vibrating roller 3 and are held adherent to said cam by pressure mechanisms (not shown) of the dampening rollers 4' and 4'', causes the approaching and separating movements thereof and the consequent application and release of the pressure.

The metering-paring roller 5, which is rubber covered, is driven by the fishing or dipping roller 1 and is mounted, in an adjustable way, in order to allow by changing the pressure for a precise adjustment of the scraping and removing action thereof on the excess liquid collected and transported by said dipping roller, said excess liquid being returned to the underlying tray V.

This adjustment is provided by the spring 55 and by the registering or setting screw 56, acting opposingly and directly onto the movable supporting member 57 carrying the bearing 58 of the metering-paring roller 5.

The aforesaid spring acts to maintain or hold separated said metering-paring roller from the dipping roller 1, and the registering or setting screw 56, by opposing the action of said spring, controls the separating amount and, hence, the dampening liquid amount taken up by the dipping or fishing roller 1.

The transversal distributing or spreading of the dampening liquid onto said dipping roller, is adjustable and determined by the slanting of the metering-paring roller with respect to said dipping roller.

The supporting members 59, located on the two sides of the machine, are articulated on two pins 60 of the dipping roller 1, provided with a slot centered on said pins and setting screws 61, and carry the guiding members within which slide the movable supporting members 57 carrying the swinging bearing 58 of the metering-paring roller 5.

By oppositely rotating the two aforesaid supporting members 59, the slanting of the metering-paring roller is automatically varied, with respect to the dipping roller, and therefore also changes the distribution or spreading of the dampening liquid on said dipping roller.

It should moreover be pointed out that the second vibrating roller 6, provided with a metal copper-plated surface, being mounted on two resilient supporting members which hold constant the pressure thereof onto the upper dampening roller 4', assures a continuous action of scraping or removing of the dampening excess liquid, accumulating onto said upper dampening roller, whereupon the plate rejects said excess liquid.

The supporting member 62 of the aforesaid dampening roller 4' and, analogously, the supporting members of the other rollers which have to be replaced as the dampening system is switched over, is effective to be quickly located and locked and has built therein the bearing 63 of that same roller.

The supporting member consists of the shaft 62, bored and axially cut all along a great portion of the length thereof, in order to make said shaft expandible, the last portion of the hole being blind and threaded, while the central portion of said hole is tapered.

Onto the aforesaid shaft are keyed, at the outside thereof and at the non-perforated end, the bearing 63 fixed by the screw 64 and, in the inside thereof, the small shaft or spindle 65, threaded at one end thereof, tapered for a length and provided with a handle 66 at the other end thereof.

The quick locating, locking, unlocking and unthreading of the supporting member 62 of the upper dampening roller 4' are carried out by operating only the handle 66 of the spindle 65.

Said handle, which allows for said supporting member to be screwed onto or unthreaded from the spindle, causing said spindle to expand and simultaneously pushing or pulling said spindle, allows precisely that said spindle may be quickly located and locked in the eccentrical bush 67 which, in turn, upon adjusting the pressure onto the dampening roller 4', onto the cylinder plate L, is locked onto the roller 53 holding arm.

It should moreover be pointed out that the dampening assembly B is completely separated from the inking assembly 1 formed by the roller assemblies 1' and 1'' supplied by the tray C.

From the above description and the figures of the accompanying drawings, it will be seen that the improved dampening device according to the invention is characterized in that:

1. It comprises seven rollers (FIG. 1).

Figure 3:
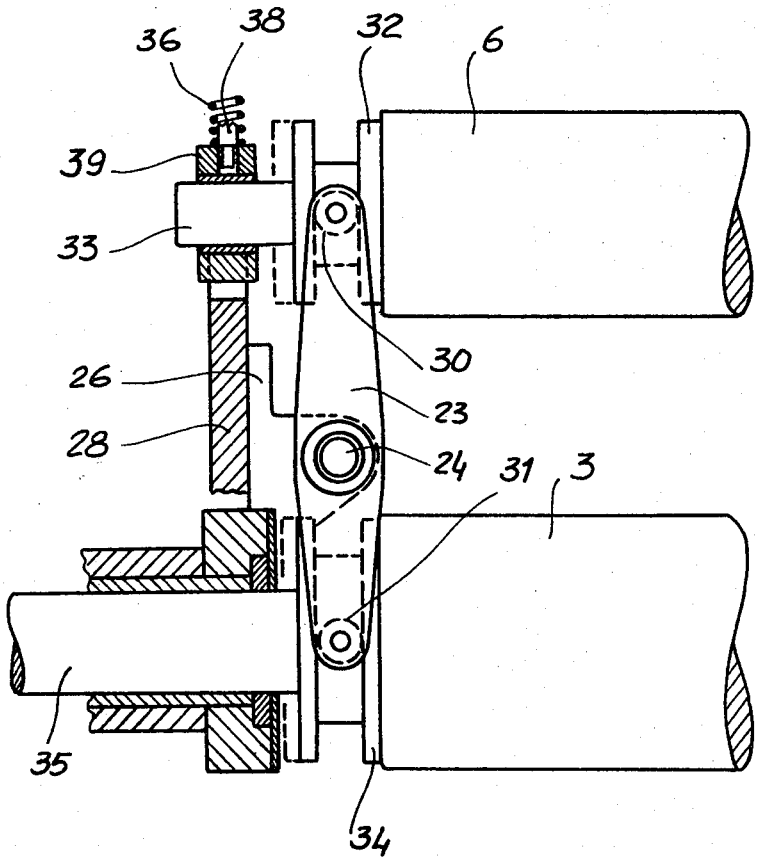
FIG. 3 illustrates a mechanism driving the reciprocating axial movement of the second vibrating roller, as offset by 180° with respect to the reciprocating axial movement of the aforesaid first vibrating roller.
Figure 4:
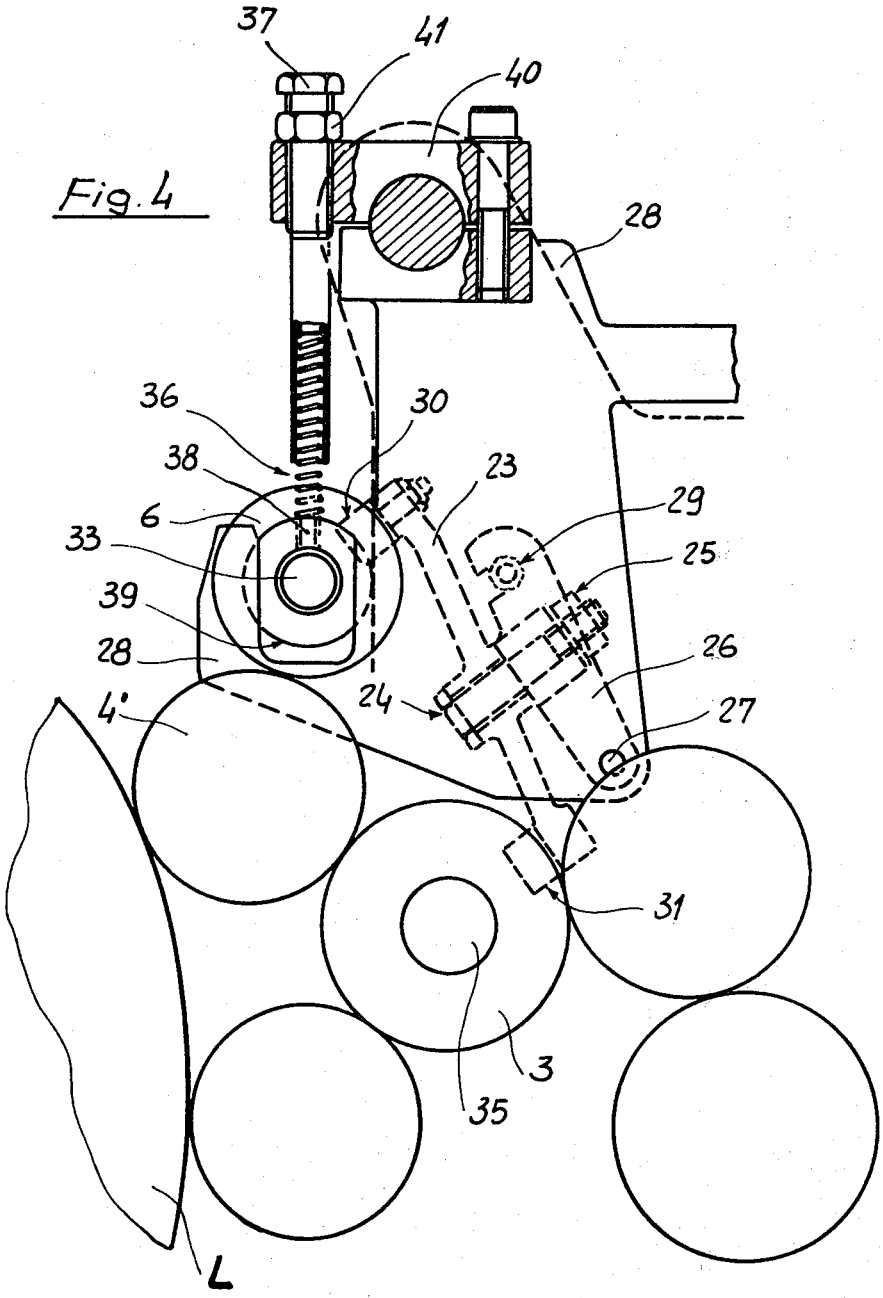
FIG. 4 illustrates a device adjusting the pressure of that same second vibrating roller onto the upper dampening roller.

2. It is provided with a second vibrating roller, which recovers and redistributes the excess dampening liquid which accumulates on the upper dampening roller, where the plate rejects said excess liquid (FIGS. 1, 3 and 4).

3. It comprises five roller assemblies, a part of which forms the connection between the adjacent assemblies, which assemblies, from the operational point of view, may be considered as independent, althrough they are interconnected and cooperating (FIG. 1):

(a) a dampening roller assembly comprising the dampening rollers 4' and possibly 4'' which provides the dampening of the surface of the plate L;

(b) a vibrating roller assembly formed by those same dampening rollers 4' and possibly 4'', by the transfer roller 2 and vibrating roller 3 cooperating with the first rollers, and assuring an even transferring of the dampening liquid from the transfer roller to the dampening rollers;

(c) a continuous supplying roller assembly, including that same transfer roller 2 and the dipping roller 1, which takes up the dampening liquid from the tray V and transfers said wetting liquid to the rollers of the dampening assembly, and more precisely to the vibrating roller 3;

(d) a metering and paring roller assembly formed by that same dipping roller 1 and by the metering-paring roller 5, cooperating with the first, which allows for the liquid continuously supplied by the supplying assembly to be metered and transversely pared;

(e) a recovering and paring roller assembly, formed by that same upper dampening roller 4' and by the second vibrating rollers 6, cooperating therewith, assuring the recovering and even distributing of the excess dampening liquid accumulating on the upper dampening roller 4' where the plate rejects said excess liquid.

Figure 7:
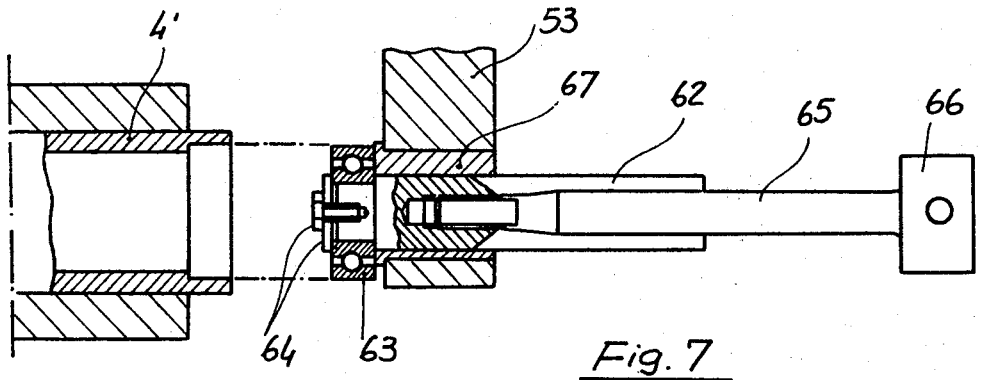
FIG. 7 illustrates a device for locating and quickly locking the rollers which have to be replaced as the dampening system is changed over.

4. It uses, for the dampening rollers and transfer roller, supporting members effective to permit quick, easy and reliable disassembling and reassembling operations thereof (FIG. 7).

Figure 2:
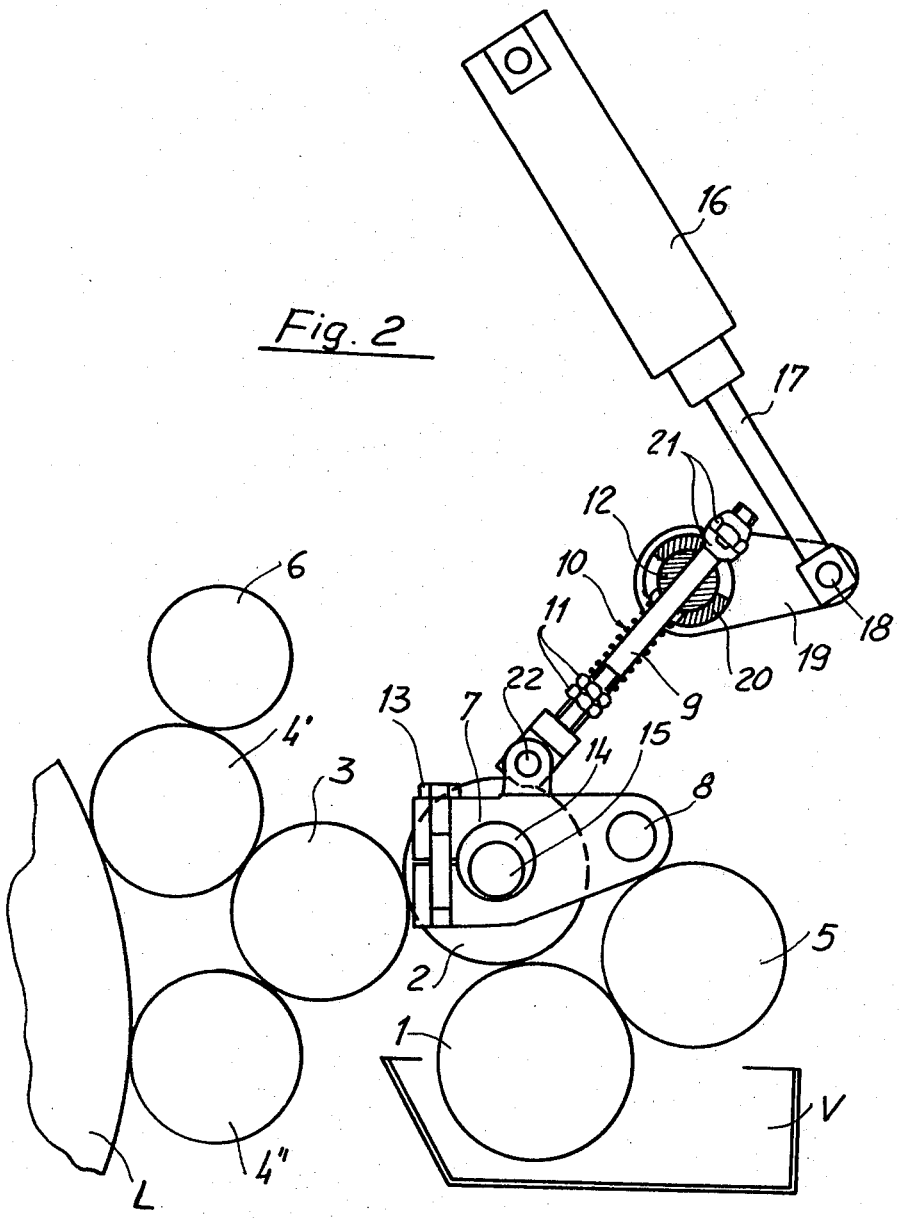
FIG. 2 illustrates a device to adjust the pressure and relative position of the transfer roller with respect to the fishing roller and first vibrating roller.
Figure 5:
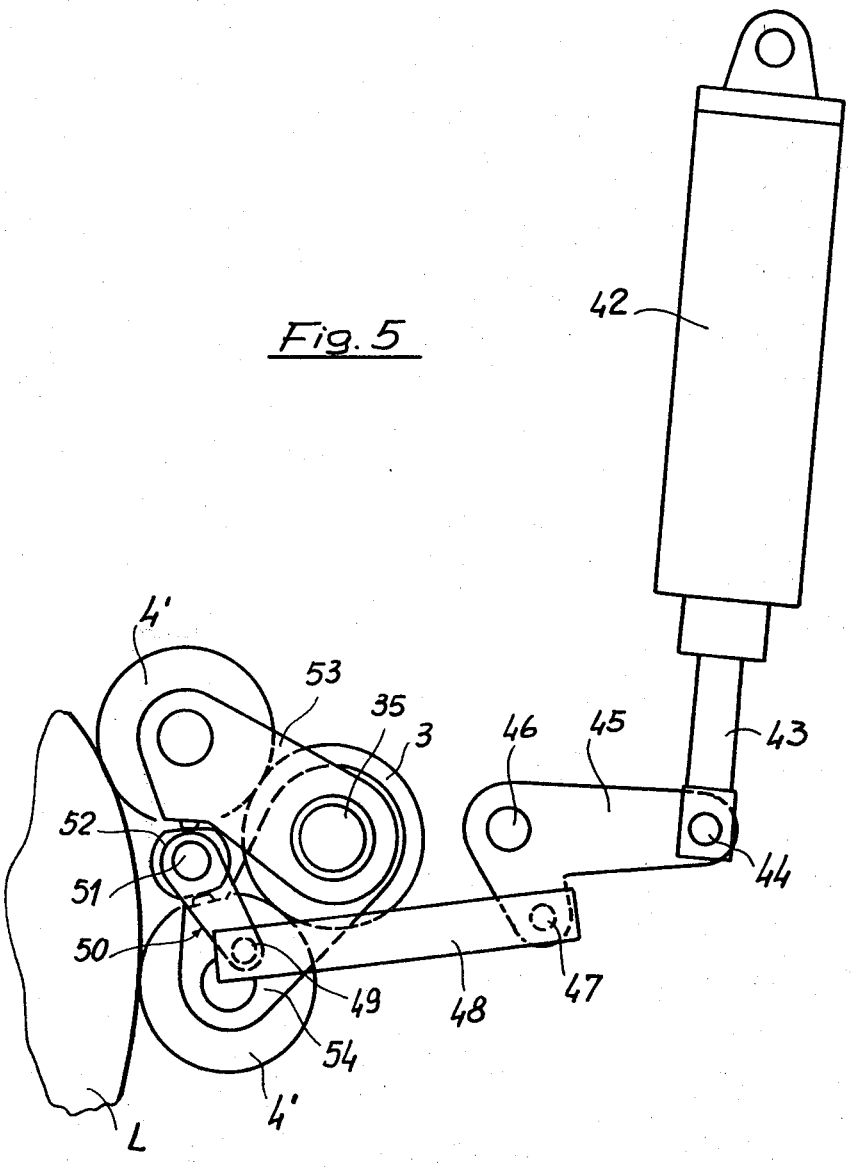
FIG. 5 illustrates a device to adjust the relative position of the dampening rollers with respect to the plate cylinder.
Figure 6:
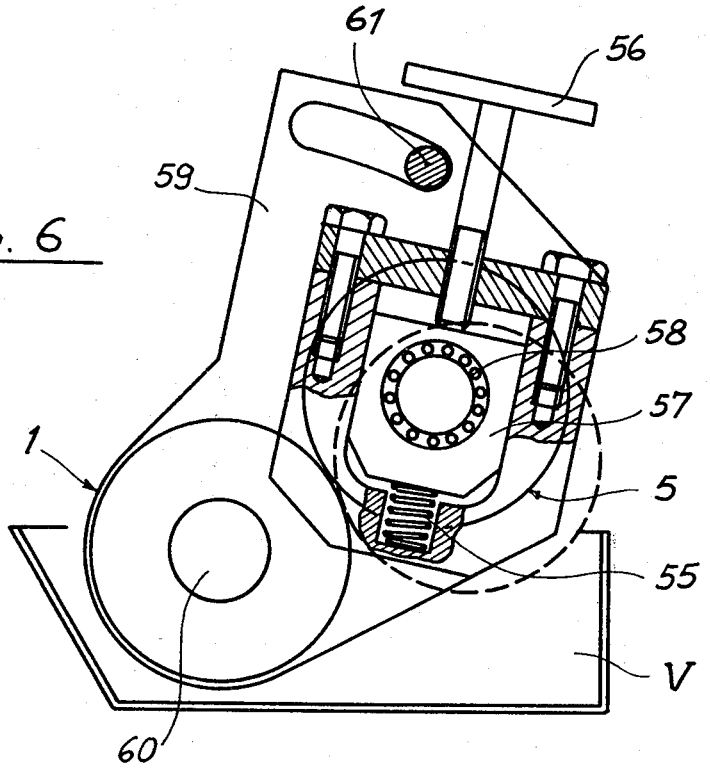
FIG. 6 illustrates a device to allow for adjustment of the pressure and of the related position of the metering paring roller with respect to the dipping roller.

5. It uses centralized pneumatic driving or controlling elements which are separated from one another, in order to "pressurize" the transfer roller and the dampening rollers (FIGS. 2 and 5) which allows for the doctor roller to exercise pressure on the dipping roller independently from the pressurization of the dampening rollers on the plate cylinder, and allowing for these latter to automatically exercise pressure as the paper begins to lower onto the entered table.

This allows for the dampening liquid to circulate through the overall wetting assembly, even during printing stops and hence to begin the printing operation without difficulties and under optimal conditions, both with the conventional water dampening and with the water-alcohol dampening.

It has been determined that the roller quality, the surface finishing, the combination, cooperative organization, movements and related controls, as hereinabove listed and described, the presence of a second vibrating roller effective to recover-pare the excess dampening liquid rejected by the plate, the functionality of the supporting members for the dampening rollers and transfer roller, and the independency and penumatically centralized driving of the "pressurization" of the transfer roller and dampening rollers, allow the improved dampening device according to the invention to be used alternatively and selectively both with water and water-alcohol, thereby obtaining, in both cases high quality and even printing.

I claim:

1. A dampening device for a printing press including a plate cylinder and an inking assembly, which dampening device supplies one of at least two types of dampening fluid including water and a water-alcohol mixture to the plate cylinder and is separate from the inking assembly and which comprises a dampening assembly formed by two dampening rollers (4', 4'') tangentially rotatably contacting said plate cylinder, a vibrating assembly formed by a first vibrating roller (3) in rolling engagement with at least one of said dampening rollers; a transfer roller (2) in rolling engagement with said first vibrating roller and with a dipping roller (1) which is partially immersed in a tray containing said dampening fluid; a metering and paring assembly formed by said dipping roller and a metering-paring roller (5) contacting only said dipping roller (1) upstream of the contacting zone between said dipping roller (1) and said transfer roller; a recovering and paring assembly formed by said dampening rollers and a second vibrating roller (6) which contacts only one of said dampening rollers downstream of the contacting zone between said dampening roller and the plate cylinder; said first vibrating roller (3) having and imparting a reciprocating axial motion to said second vibrating roller (6), and lever means responsive to the vibration of the first vibrating roller (3) and engaging said second vibrating roller (6) for imparting to said second vibrating roller said reciprocating motion and wherein said two dampening rollers and said transfer roller cooperate in series and in parallel with the first vibrating roller, said dampening rollers and said transfer roller being removable and the dampening assembly comprises means for removing said removable dampening rollers and said transfer roller; one of said dampening rollers being the upper dampening roller, and said device includes means for coupling said vibrating rollers (3) and (6) for synchronous reciprocating axial movement, said coupling means including respective grooves on said vibrating rollers (3) and (6), said grooves receiving follower members carried on a lever (23) supported for pivotal movement about a given axis, and spring means connected to one said roller (6) and adjustable to vary the contact pressure exerted by said roller (6) onto said dampening roller (4'); and further including first pneumatic means operable to actuate camming means, said camming means acting on spring means to selectively pressurize said transfer roller, said transfer roller exerting pressure on said dipping roller and on said first vibrating roller; and further comprising means for substituting the dampening and transfer rollers, said means comprising a collet (62), a tapered spindle within the collet disposed for threaded engagement therewith to effect relative axial movement between said spindle and said collet, in accordance with the rotation of said spindle, a bushing (67) receiving said collet therethrough to guide the axial movement thereof along an axis established by said bushing, support means holding said bushing in an established position, a bearing (63) connected to said collet for movement therewith, said bearing being movable axially into and out of receiving engagement with a bearing housing of one said dampening rollers by the action of said collet and spindle.

2. The device according to claim 1, wherein said metering-paring roller (5) is slantingly adjustable with respect to the dipping roller (1) and including adjustment means connected to an end bearing (58) of the metering-paring roller (5) and operable to adjust the position of the end of said metering-paring roller (5) about the dipping roller (1) to control the slanting of said metering-paring roller (5) relative to the dipping roller (1), said adjustment means comprising a bearing block (57) receiving and supporting said end bearing (58), guides engaging said bearing block (57) to constrain same for limited movement along a given path, a screw (56) engaging said bearing block (57) to position same along said path, and a spring (55) engaging said bearing block (57) to resiliently oppose the positioning action of said screw (56).

3. The device according to claim 1, which comprises means for adjusting the pressure of the dampening rollers onto said plate cylinder and onto the first vibrating roller, said means comprising second pneumatic means which actuate linkage means pivotally connecting said dampening rollers to said vibrating rollers and camming means acting upon links connected respectively to said dampening rollers and operable to vary the center-to-center distance of said dampening rollers, said linkage means being operable to move the dampening rollers with resepct to said plate cylinder.

4. The device according to claim 1, wherein said dampening rollers and said transfer roller are covered by rubber and textile braiding.

5. The device according to claim 1, wherein said dampening rollers and said transfer roller are covered by rubber.

6. The device according to claim 1, wherein said first and said second pneumatic means are separated from one another and independently controlled.

* * * * *